US008746006B2

(12) United States Patent
Kim

(10) Patent No.: US 8,746,006 B2
(45) Date of Patent: Jun. 10, 2014

(54) REFRIGERATOR

(75) Inventor: Seok-Ro Kim, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 648 days.

(21) Appl. No.: 12/937,547

(22) PCT Filed: Dec. 30, 2008

(86) PCT No.: PCT/KR2008/007776
§ 371 (c)(1),
(2), (4) Date: Oct. 13, 2010

(87) PCT Pub. No.: WO2009/131295
PCT Pub. Date: Oct. 29, 2009

(65) Prior Publication Data

US 2011/0030417 A1 Feb. 10, 2011

(30) Foreign Application Priority Data

Apr. 23, 2008 (KR) ..... 10-2008-0037921

(51) Int. Cl.
*E05D 7/04* (2006.01)
*E05D 7/06* (2006.01)

(52) U.S. Cl.
USPC ..... 62/449; 62/448; 16/235; 16/239; 16/240; 16/241; 16/242; 16/244; 16/245; 16/324; 16/326

(58) Field of Classification Search
CPC . E05D 11/1014; E05D 7/0027; E05D 7/0054; E05D 7/04; E05D 5/12; E05Y 2201/638; F25D 2400/06; F25D 2323/024
USPC ..... 62/449, 448; 312/401, 405; 16/324, 16/326, 354, 244, 221, 235, 248, 319
See application file for complete search history.

(56) References Cited

U.S. PATENT DOCUMENTS

| | | | | |
|---|---|---|---|---|
| 4,109,346 | A * | 8/1978 | Strozier | 16/235 |
| 7,240,397 | B2 * | 7/2007 | Han | 16/50 |
| 7,490,384 | B2 * | 2/2009 | Lee | 16/244 |
| 8,166,611 | B2 * | 5/2012 | Moon | 16/240 |

(Continued)

FOREIGN PATENT DOCUMENTS

| | | | |
|---|---|---|---|
| KR | 10-19990038589 | A | 6/1999 |
| KR | 10-20010057905 | A | 7/2001 |
| KR | 10-20060125394 | A | 12/2006 |

OTHER PUBLICATIONS

International Search Report dated Apr. 27, 2009 for Application No. PCT/KR2008/007776, 2 pages.

*Primary Examiner* — Frantz Jules
*Assistant Examiner* — Martha Tadesse
(74) *Attorney, Agent, or Firm* — Fish & Richardson P.C.

(57) ABSTRACT

A refrigerator comprises: a body having a storage chamber; a door for selectively shielding the storage chamber; a hinge coupling portion for hinge-coupling the door to the body; and a height control unit for lifting up or lowering the door by repeatedly opening and closing the door. Since the door has a controllable height by being opened and closed, a moment arm becomes longer than when using the conventional tool such as a spanner. This may allow the height of the door to be controlled by using less force. Since the height of the door is controllable at a user's eye height, the user may control the height of the door more rapidly and precisely without errors.

14 Claims, 4 Drawing Sheets

(56) References Cited

U.S. PATENT DOCUMENTS

| | | | | |
|---|---|---|---|---|
| 8,388,077 | B2 * | 3/2013 | Park | 312/405 |
| 2005/0262663 | A1 * | 12/2005 | Lee | 16/221 |
| 2006/0143860 | A1 * | 7/2006 | Park et al. | 16/243 |
| 2006/0244351 | A1 * | 11/2006 | Moon et al. | 312/405 |
| 2009/0184554 | A1 * | 7/2009 | Paing et al. | 297/358 |
| 2010/0218342 | A1 * | 9/2010 | Bertolini et al. | 16/244 |

* cited by examiner

REFRIGERATOR

TECHNICAL FIELD

The present invention relates to a refrigerator, and more particularly, to a refrigerator capable of controlling a height of a door by merely opening and closing the door in a repetitive manner.

BACKGROUND ART

Generally, a refrigerator serves to freshly store each kind of food items for a long time in a cooled state or a frozen state by supplying cool air to a storage chamber. The cool air is generated by a refrigeration cycle for circulating a refrigerant through compression, condensation, expansion, and evaporation processes.

The refrigerator includes a body provided with a storage chamber, and a door for selectively opening and closing the storage chamber.

The door is hinge-coupled to the body, and is rotated centering around a hinge shaft to open and close the storage chamber.

The door has to be installed at a precise position of the body, so that the storage chamber can be smoothly opened and closed by the door, or so that the storage chamber can be better shielded by the door.

For this, a height control apparatus has been disclosed. The height control apparatus has a structure that a screw thread to which a height control nut is fitted is formed at a hinge coupling portion to which the door is hinge-coupled, and the nut is supported by the body.

However, the conventional height control apparatus has the following problems.

Firstly, in order to control a height of the door, the nut is rotated by using an additional tool such as a spanner. This may cause a user's inconvenience to prepare the additional tool, and an unskilled person may have a difficulty in manipulating the additional tool.

Secondly, sine the hinge coupling portion is disposed at a lower end of the refrigerator, a user has to lower his or her posture to control the height of the door.

Thirdly, while the user lowers his or her posture to control the height of the door, the user can not check the height of the door. This may cause the user to change his or her postures a plurality of times.

DISCLOSURE OF INVENTION

Technical Problem

Therefore, it is an object of the present invention to provide a refrigerator capable of controlling a height of a door by merely opening and closing the door in a repetitive manner.

Technical Solution

To achieve these and other advantages and in accordance with the purpose of the present invention, as embodied and broadly described herein, there is provided a refrigerator, comprising: a body having a storage chamber; a door for selectively shielding the storage chamber; a hinge coupling portion for hinge-coupling the door to the body; and a height control unit for lifting up or lowering the door by repeatedly opening and closing the door.

The hinge coupling portion is provided on upper and lower surfaces, respectively. And, at least one of the hinge coupling portions may be replaced with the height control unit.

The height control unit includes a hinge portion having one end screw-coupled to the body so as to be vertically movable, and another end for rotatably supporting the door; and a height controller installed at the door, for rotating the hinge portion in a locking manner when the door is opened and closed.

The height controller includes a plurality of hooking portions formed at one side of the hinge portion in a circumferential direction; a selection lever for determining whether to lock the hinge portion or not; locking members selectively coupled to the hooking portions by the selection lever; and a lever bracket portion fixed to the door, and to which the selection lever and the locking members are coupled.

The selection lever is exposed to outside of the lever bracket portion, and is configured so that a lifting mode, a lowering mode, and a neutral mode of the hinge portion can be selected.

The hinge portion is rotated by being locked by the height controller only in one state of an opened state and a closed state of the door.

The hooking portions are formed in a lengthwise direction of the hinge portion, and are implemented as a plurality of grooves entirely formed at the hinge portion in a circumferential direction.

The locking members are disposed at both sides of the hooking portions, and have one side rotatably coupled to the lever bracket portion. And, the locking members come in contact with the hooking portion by the selection lever, thereby selectively locking rotation of the hinge portion in one direction.

Advantageous Effects

The refrigerator according to the present invention has the following advantages.

Since the door has a controllable height by being opened and closed, a moment arm becomes longer than when using the conventional tool such as a spanner. This may allow the height of the door to be controlled by using less force.

Also, since the height of the door is controllable at a user's eye height, the user may control the height of the door more rapidly and precisely without errors.

Furthermore, since the door has a controllable height by being merely opened and closed, may be solved a user's inconvenience to provide an additional tool.

BEST MODE FOR CARRYING OUT THE INVENTION

Reference will now be made in detail to the preferred embodiments of the present invention, examples of which are illustrated in the accompanying drawings.

Hereinafter, a refrigerator according to a first embodiment of the present invention will be explained in more detail with reference to FIG. 1.

Figure 1:
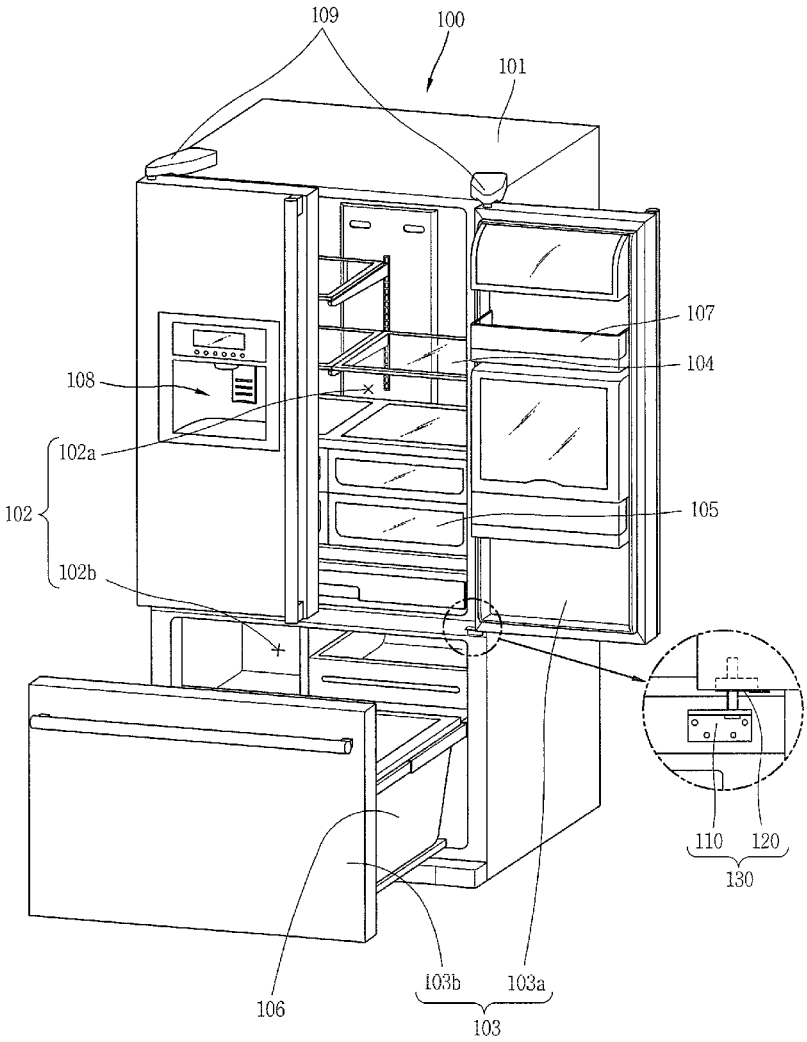
FIG. 1 is a view showing inside and appearance of a refrigerator according to a first embodiment of the present invention.

FIG. 1 is a view showing inside and appearance of a refrigerator according to a first embodiment of the present invention.

Referring to FIG. 1, a refrigerator 100 according to a first embodiment of the present invention comprises a body 101 having a storage chamber 102 for storing various items to be stored, and a door 103 for selectively shielding the storage chamber 102.

The body 101 is composed of an outer case that forms appearance of the refrigerator 100, and an inner case that forms a wall surface of the storage chamber 102. An insulating material is filled between the outer case and the inner case, thereby insulating inside of the body 101 from outside.

The storage chamber 102 is composed of a refrigerating chamber 102*a* for freshly storing items such as food and beverage in a cooled state, and a freezing chamber 102*b* for storing items such as fish and meat in a frozen state.

FIG. 1 illustrates the body 101 in which the refrigerating chamber 102*a* is disposed at an upper side, and the freezing chamber 102*b* is disposed at a lower side. However, it will be apparent to those skilled in the art that various modifications and variations of the refrigerator can be made in the present invention.

For instance, the refrigerating chamber 102*a* and the freezing chamber 102*b* may be horizontally provided side by side. Alternatively, the refrigerating chamber 102*a* may be provided at a lower side of the freezing chamber 102*b*.

The door 103 serves to shield the storage chamber 102 from outside. And, the door 103 may be composed of a refrigerating chamber door 103*a* for shielding the refrigerating chamber 102*a*, and a freezing chamber door 103*b* for shielding the freezing chamber 102*b*.

The door 103 may be provided to be hinge-coupled to the body 101 by a hinge coupling portion 109 that supports the body 101 in a rotation-movable state centering around one side of the body 101. However, as shown in FIG. 1, the door 103 may be implemented as a withdrawing type door. The number of the door 103 for shielding one storage chamber 102 is not limited to one, but may be two or more than.

The hinge coupling portions 109 are provided on upper and lower surfaces of the door.

Variable modifications of the door 103 are well known to those skilled in the art, and detailed constructions and operations thereof will be omitted.

Shelves 104, drawers 105, a basket 106, etc. for storing food items may be provided in the refrigerating chamber 102*a* and the freezing chamber 102*b*. A door basket 107 may be provided on a rear surface of the freezing chamber door 103*a*, i.e., on a surface toward the refrigerating chamber 102 when the freezing chamber door 103*a* is closed.

A dispenser 108 may be provided at the door 103 so that water or ice can be drawn out from outside of the body 101.

Although not shown in FIG. 1, a refrigeration cycle that generates cooled air to be supplied to the storage chamber 102 is provided at one side of the body 101, i.e., on a rear surface of the body 101. In order to supply cooled air to the storage chamber 102, a cool air supply apparatus is provided at the body.

The refrigeration cycle uses a refrigerant as operation fluid, and generates cooled air through compression, condensation, expansion, and evaporation processes. A refrigeration cycle may be properly selected by those skilled in the art according to a usage purpose of the refrigerator 100. Therefore, a detailed explanation of the refrigeration cycle will be omitted.

The refrigerator 100 according to the present invention is provided with a height control unit 130 for controlling the height of the door 103 by merely opening and closing the door 103 in a repetitive manner.

Since the height of the door 103 is controllable by a user or a manufacturer without an additional tool, the refrigerator 100 may have a fine appearance. And, this also prevents leakage of cool air from the storage chamber 102 occurring as the storage chamber 102 is not completely shielded by the door 103 due to an unsuitable height of the door 103.

Hereinafter, the height control unit 130 of the refrigerator according to the first embodiment of the present invention will be explained in more detail.

Figure 2:
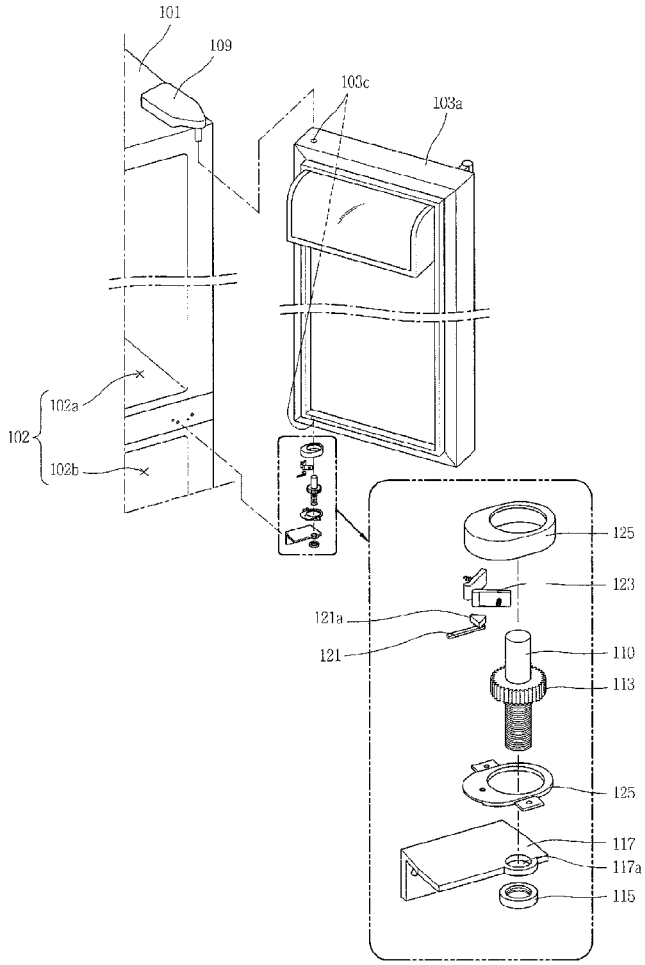
FIG. 2 is an exploded perspective view of a height control unit of FIG. 1.
Figure 3:
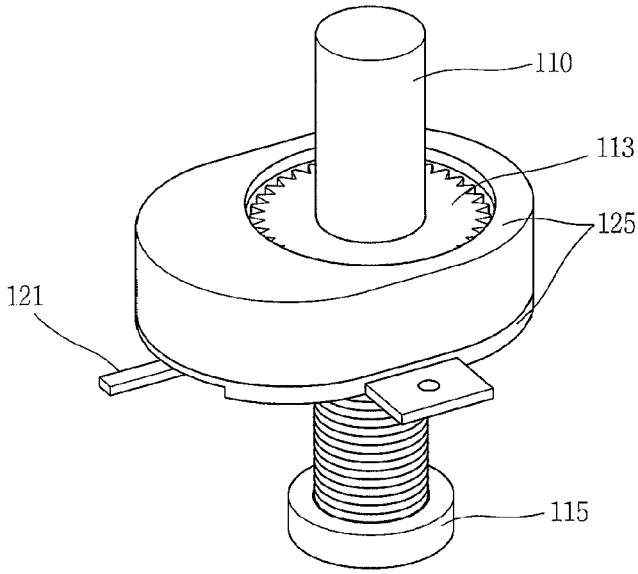
FIG. 3 is an assembled perspective view of the height control unit of FIG. 1.

FIG. 2 is an exploded perspective view of a height control unit of FIG. 1, and FIG. 3 is an assembled perspective view of the height control unit of FIG. 1.

Referring to FIGS. 2 and 3, the height control unit 130 includes a hinge portion 110 for supporting the door 103, and a height controller 120 for controlling the height of the door 103 by selectively rotating the hinge portion 110.

At least one of the hinge coupling portions 109 may be replaced with the height control unit 130. Accordingly, the height control unit 130 is installed on one of upper and lower surfaces of the door 103, thereby supporting the door 103.

The height control unit 130 may further include a hinge bracket portion 117 fixed to the body 101, and to which the hinge portion 110 is screw-coupled so as to be movable in upper and lower directions. The hinge bracket portion 117 is coupled to one side of the body 101. And, a through hole 117*a* having a female screw portion to which the hinge portion 110 is screw-coupled is formed at another side of the body 101.

The hinge portion 110 is provided in upper and lower directions of the body 101 so as to serve as a rotation shaft of the door 103. One end of the hinge portion 110 is screw-coupled to the body 101 so as to be movable in upper and lower directions. And, another end of the hinge portion 110 is inserted into an insertion groove 103*c* formed on an upper surface of a lower surface of the door 103, thereby rotatably supporting the door 103.

Under this configuration, the hinge portion 110 is rotated to lift up or lower the door 103.

The height controller 120 is provided so as to rotate the hinge portion 110 by interworking with an opening operation or a closing operation of the door 103.

Hereinafter, the height controller 120 will be explained in more detail.

The height controller 120 includes locking members 123 selectively contacting the hinge portion 110 for transmitting a rotational force to the hinge portion 110, a selection lever 121 for controlling contact between the locking members 123 and the hinge portion 110, hooking portions 113 formed at the hinge portion 110, and a lever bracket portion 125 fixed to the door 103, and to which the selection lever 121 and the locking members 123 are coupled.

The hooking portions 113 are entirely formed along the circumference of the hinge portion 110, and are implemented as a plurality of grooves formed in a lengthwise direction of the hinge portion 110.

Preferably, the hooking portions 113 are formed to be protruding from the hinge portion 110 by a predetermined length in a radius direction of the hinge portion 110. Accordingly, the hooking portions 113 are preferably protruding from the circumference of the hinge portion 110.

Since the length of the hooking portions 113 serves as a moment arm of a rotation force transmitted to the hinge portion 110, a large rotation force can be transmitted to the hinge portion 110 due to the locking members 123 with less force when the door 103 is opened and closed.

The locking members 123 are provided so as to selectively come in contact with the hooking portions 113 by the selection lever 121.

The locking members 123 are provided at both sides of the hooking portions 113 in a radius direction. One side of the locking members 123 is rotatably coupled to the lever bracket portion 125, and another side of the locking members 123 is rotated by the selection lever 121 thus to come in contact with the hooking portions 113.

The locking members 123 come in contact with the hooking portions 113 as one side thereof is coupled to the lever bracket portion 125 by an elastic member.

The locking members 123 lock the hinge portion 110 when the door 103 is in one state of an opened state and a closed state, thereby transmitting a rotational force to the hinge portion 110 so that the hinge portion 110 can be rotated in one direction. However, when the door 103 is in another state of an opened state and a closed state, the locked state of the hinge portion 110 is released.

Accordingly, only when the door 103 is in one state of an opened state and a closed state, the hinge portion 110 is rotated to be lifted up or lowered.

Whether to lift up or lower the hinge portion 110 may be determined according to which one of the two locking members 123 disposed at both sides of the hooking portions 113 come in contact with the hooking portions 113.

The selection lever 121 may determined whether to lift up or lower the hinge portion 110.

The selection lever 121 is rotatably coupled to the lever bracket portion 125, and is installed to come in contact with the locking members 123.

The selection lever 121 is exposed to outside of the lever bracket portion 125, and is configured so that a lifting mode, a lowering mode, and a neutral mode of the hinge portion 110 can be selected.

A contact portion 121*a* formed at a front end of the selection lever 121 contacting the locking members 123 is provided in a predetermined cam shape so that only one of the two locking members 123 can come in contact with the hooking portions 113 when the selection lever 121 is rotated.

Preferably, the contact portion 121*a* of the selection lever 121 is formed in an approximate triangular shape. And, vertexes disposed at both ends of a lower edge preferably come in contact with the locking members 123.

Contact grooves 123*a* are formed at contact parts between the locking members 123 and the selection lever 121. A status that the contact grooves 123*a* come in contact with the vertexes of the contact portion 121*a* is referred to as 'neutral mode', and one of the contact grooves 123*a* is separated from the contact portion 121*a* is referred to as 'lifting or lowering mode'.

In the lifting or lowering mode, the locking members 123 come in contact with the edges of the triangular contact portion, thereby coming in contact with the hooking portions 113.

It is apparent to those skilled in the art that the lifting or lowering mode can be controlled by a manufacturer's selection.

The lever bracket portion 125 is formed as the locking members 123 and the selection lever 121 are coupled to each other, and is insertion-fixed to an upper surface of a lower surface of the door 103.

Preferably, a bracket accommodating portion 103*d* for inserting the lever bracket portion 125 is formed at the hinge coupling portion 109 of the door 103 having the height control unit 130.

The lever bracket portion 125 is configured to be rotated together when the door 103 is rotated. And, the selection lever 121 and the locking members 123 coupled to the lever bracket portion 125 selectively rotate the hinge portion 110.

At the end of the hinge portion 110, preferably formed is a separation prevention portion 115 for preventing separation of the hinge portion 110 from the hinge bracket portion 117 due to excessive rotation.

Hereinafter, a coupling process between the height control unit 130 and the refrigerating chamber door 103*a* will be explained in more detail with reference to FIGS. 4 and 5.

Figure 4:
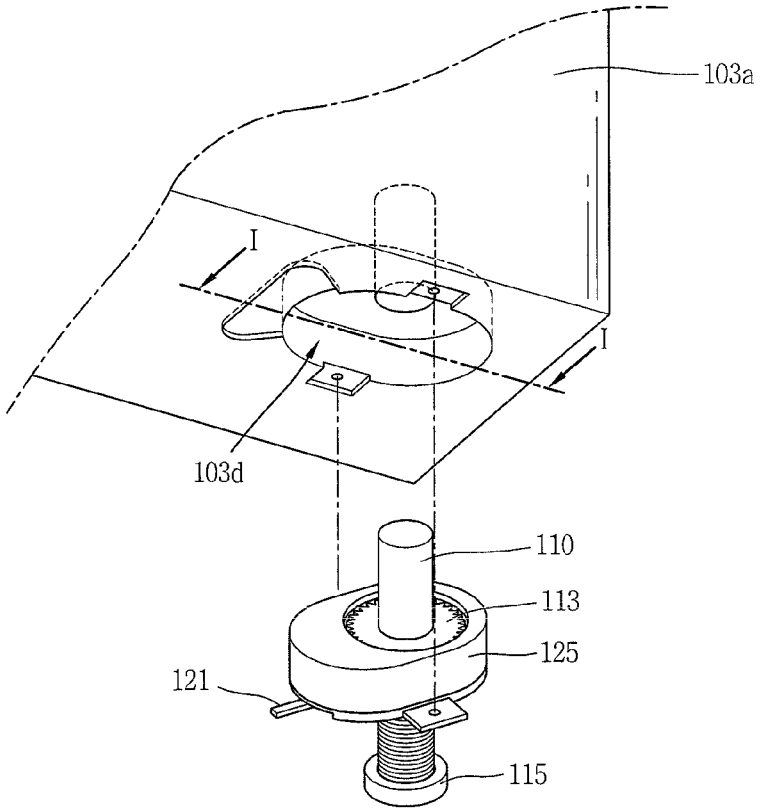
FIG. 4 is a view showing a coupling process between the height control unit of FIG. 3 and a door.
Figure 5:
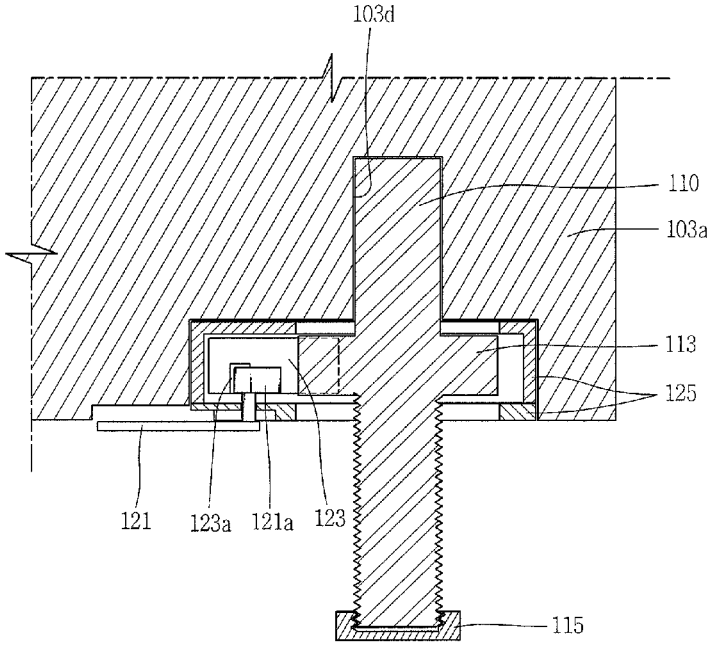
FIG. 5 is a sectional view taken along line 'I-I' in FIG. 4.

FIG. 4 is a view showing a coupling process between the height control unit of FIG. 3 and a door, and FIG. 5 is a sectional view taken along line 'I-I' in FIG. 4.

Referring to FIGS. 4 and 5, the selection lever 121 and the locking members 123 are coupled to the lever bracket portion 125.

Here, the contact portion 121*a* of the selection lever 121 is fitted into the contact grooves 123*a* of the locking members 123. And, one side of the locking members 123 is coupled to an inner side surface of the lever bracket portion 125 and an elastic member 125*a* thus to be supported.

Then, the hinge portion 110 is fitted into the lever bracket portion 125 so that the hooking portions 113 can be disposed between the two locking members 123.

Under this state, a lower side of the hinge portion 110 is screw-coupled to one side of the body 101 or the hinge bracket portion 117, and the lever bracket portion 125 is accommodated in the bracket accommodating portion 103*d* formed on a lower surface of the door 103. And, the hinge portion 110 supports the door 103.

As the door 103 is repeatedly opened and closed by the selection lever 121, the door 103 is lifted up or lowered.

Hereinafter, a process for controlling the height of the door 103 by the height control unit 130 in the refrigerator according to the present invention will be explained with reference to FIGS. 6 and 7.

Figure 6:
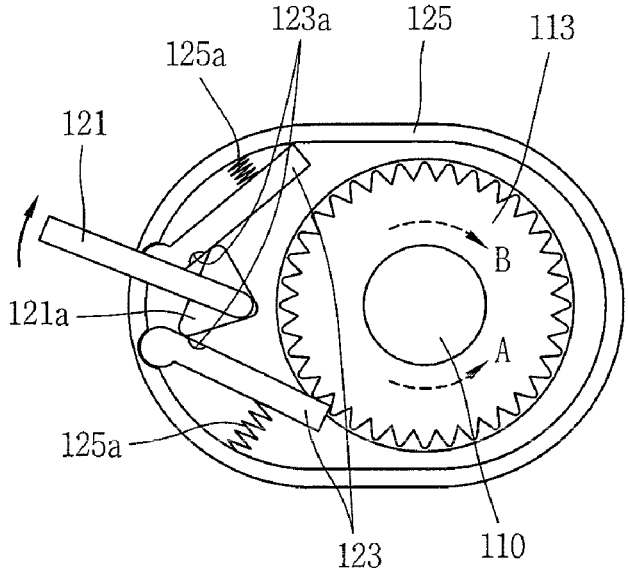
FIG. 6 is a view showing an operation state of a height controller according to a first embodiment of the present invention.
Figure 7:
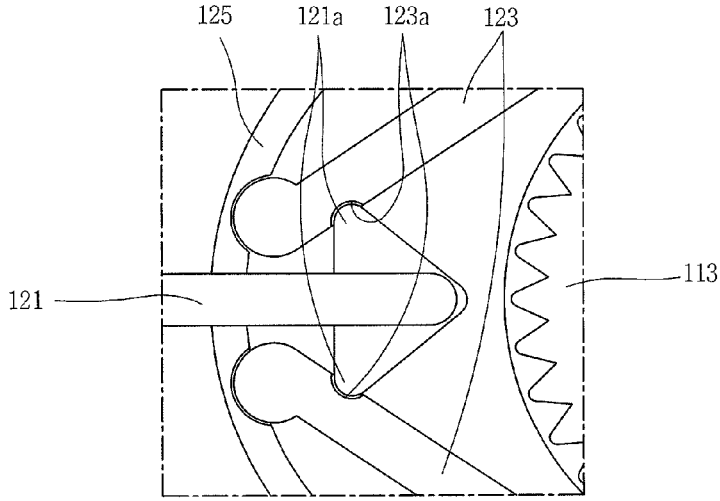
FIG. 7 is a view showing a coupled state between a selection lever and locking members in a neutral state of the height control unit of FIG. 6.

FIG. 6 is a view showing an operation state of a height controller according to a first embodiment of the present invention, and FIG. 7 is a view showing a coupled state between a selection lever and locking members in a neutral state of the height control unit of FIG. 6.

Referring to FIGS. 6 and 7, when the selection lever 121 is in a neutral mode, the vertexes of the contact portion 121*a* of the selection lever 121 come in contact with the contact grooves 123*a* of the locking members 123. This may prevent the locking members 123 from coming in contact with the hooking portions 113.

This may cause the hinge portion 110 not to be rotated even if the door 103 is repeatedly opened and closed by a user or a manufacturer. Accordingly, the door 103 may maintain a constant height.

However, when the selection lever 121 is moved to one direction by a user or a manufacturer, one of the locking members 123 comes in contact with the edge of the contact portion 121*a* of the selection lever 121, thereby contacting the hooking portions 113.

Under this state, when the door 103 is counterclockwise rotated (direction of 'A' in FIG. 6), the hinge portion 110 is rotated by the locking members 123.

Accordingly, the hinge portion 110 is lifted up or lowered by performing a relative motion with respect to the hinge bracket portion 117 screw-coupled to the hinge portion 110, or the body 101.

On the contrary, when the selection lever 121 is downward moved in FIG. 6, the locking members 123 disposed at an upper side of the selection lever 121 come in contact with the hooking portions 113. Accordingly, the hinge portion 110 is clockwise rotated.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A refrigerator, comprising:

a body having a storage chamber;

a door for selectively shielding the storage chamber;

a hinge coupling portion coupled to the body; and a height control unit for lifting up or lowering the door, wherein the height control unit comprises:

a hinge portion having a first end screw-coupled to the hinge coupling portion, and a second end configured to rotatable support the door, and a height controller configured to rotate the hinge portion in a locking manner based on the door being opened and closed, and wherein the height controller comprises:

a plurality of hooking portions located at one side of the hinge portion in a circumferential direction, a selection lever configured to selectively lock the hinge portion, locking members selectively coupled to the hooking portions by the selection lever, the locking members causing the hinge portion to rotate responsive to opening and closing of the door based on the selection lever causing at least one of the locking members to couple to at least one of the hooking portions such that the door lifts up or lowers responsive to opening and closing of the door, and a lever bracket portion fixed to the door, and to which the selection lever and the locking members are coupled.

2. The refrigerator of claim 1, wherein the hinge coupling portion is provided on one of upper and lower surfaces of the door, and the height control unit is provided on another of the upper and lower surfaces where the hinge coupling portion is not provided.

3. The refrigerator of claim 1, wherein the height controller is installed at the door.

4. The refrigerator of claim 3, wherein the height control unit further comprises a hinge bracket portion fixed to the body, and to which the hinge portion is screw-coupled so as to be movable in upper and lower directions.

5. The refrigerator of claim 1, wherein the selection lever is exposed to outside of the lever bracket portion, and is configured such that a lifting mode, a lowering mode, and a neutral mode of the hinge portion is selected.

6. The refrigerator of claim 3, wherein the hinge portion is rotated by being locked by the height controller only in one state of an opened state and a closed state of the door.

7. The refrigerator of claim 1, wherein the hooking portions are formed in a lengthwise direction of the hinge portion, and are implemented as a plurality of grooves entirely formed at the hinge portion in a circumferential direction.

8. The refrigerator of claim 7, wherein the hooking portions are extending from the hinge portion by a predetermined length in a radius direction.

9. The refrigerator of claim 1, wherein the lever bracket portion is insertion-fixed to an upper surface or a lower surface of the door.

10. The refrigerator of claim 1, wherein the locking members are disposed at both sides of the hooking portions, and have one side rotatably coupled to the lever bracket portion, and wherein the locking members come in contact with the hooking portions by the selection lever, thus to selectively lock rotation of the hinge portion in one direction.

11. The refrigerator of claim 10, wherein two locking members are coupled to the selection lever, and only one of the two locking members comes in contact with the hooking portions by the selection lever.

12. The refrigerator of claim 1, wherein a contact portion of the selection lever contacting the locking members is provided in a predetermined cam shape so that only one of two locking members comes in contact with the hooking portions when the selection lever is rotated.

13. The refrigerator of claim 4, wherein a separation prevention portion for preventing separation of the hinge portion from the hinge bracket portion is formed at the end of the hinge portion.

14. The refrigerator of claim 12, wherein the two locking members comprise contact grooves, respectively, having contact portions of the selection lever inserted into the contact grooves for allowing the two locking members to be spaced from the hooking portions so as to remain in a neutral mode, and wherein the two locking members are elastically supported on the lever bracket portion, respectively, by elastic members.

* * * * *